US006844772B2

(12) United States Patent
Hoon et al.

(10) Patent No.: US 6,844,772 B2
(45) Date of Patent: Jan. 18, 2005

(54) THRESHOLD VOLTAGE EXTRACTION CIRCUIT

(75) Inventors: Siew Kuok Hoon, Dallas, TX (US); Jun Chen, Allen, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/316,495

(22) Filed: Dec. 11, 2002

(65) Prior Publication Data

US 2004/0113682 A1 Jun. 17, 2004

(51) Int. Cl.[7] ..... G05F 1/10

(52) U.S. Cl. ..... 327/541; 327/539; 327/543; 323/315; 323/316

(58) Field of Search ..... 327/538, 539, 327/540, 541, 543; 323/312, 313, 315, 316

(56) References Cited

U.S. PATENT DOCUMENTS

| | | | | | |
|---|---|---|---|---|---|
| 4,931,718 | A | * | 6/1990 | Zitta | 323/313 |
| 5,373,226 | A | * | 12/1994 | Kimura | 323/313 |
| 5,666,046 | A | * | 9/1997 | Mietus | 323/313 |
| 5,670,907 | A | * | 9/1997 | Gorecki et al. | 327/535 |
| 5,852,376 | A | * | 12/1998 | Kraus | 327/143 |
| 6,362,612 | B1 | * | 3/2002 | Harris | 323/312 |
| 6,381,491 | B1 | * | 4/2002 | Maile et al. | 607/2 |
| 6,528,979 | B2 | * | 3/2003 | Kimura | 323/313 |

OTHER PUBLICATIONS

Filanovsky, I.M., "An Input–Free $V_{TP}$ and $-V_{TN}$ Extractor Circuits Realized on the Same Chip," 1997 IEEE 0–7803–3694, pp. 135–138.

Seo, Yoon–Deuk, et al., "Low–Power CMOS On–Chip Voltage Reference Using MOS PTAT: An EP Approach," 1997 IEEE 1063–0988, pp. 316–320.

Johnson, Mark G., "An Input–Free $V_T$ Extractor Circuit Using a Two–Transistor Differential Amplifier," *IEEE Journal of Solid–State Circuits*, vol. 28, No. 6, Jun. 1993, pp. 704–705.

Wang, Zhenhua, "Automatic $V_T$ Extractors Based on an $n \times n^2$ MOS Transistor Array and Their Application," *IEEE Journal of Solid–State Circuits*, vol. 27, No. 9, Sep. 1992, pp. 1277–1285.

Wang, Zhenhua, "A CMOS Four–Quadrant Analog Multiplier with Single–Ended Voltage Output and Improved Temperature Performance," *IEEE Journal of Solid–State Circuits*, vol. 26, No. 9, Sep. 1991, pp. 1293–1301.

* cited by examiner

*Primary Examiner*—Terry D. Cunningham
(74) *Attorney, Agent, or Firm*—April M. Mosby; Wade James Brady, III; Frederick J. Telecky, Jr.

(57) ABSTRACT

A threshold voltage extraction circuit. The circuit includes a first current mirror having a first transistor and a second transistor. A holding circuit has an output adapted to control a current though the first current mirror by operating to maintain substantially equal the voltages at a first input thereof and at a second input thereof. A third, MOS transistor having a source and a gate, and a resistor circuit, together adapted to generate a voltage which is a multiple of a source-gate threshold voltage of the third transistor, are coupled to the second transistor and to the first input of the holding circuit. A fourth, MOS transistor coupled to the first transistor and to the second input of the subtracting circuit through a second resistor circuit is adapted to generate a threshold voltage across the second resistor circuit, by the operation of the holding circuit. A second current mirror coupled to the first current mirror is adapted to cause a current to flow through a third resistor circuit that corresponds to the current through the first current mirror to thereby provide an output voltage corresponding to the threshold voltage.

7 Claims, 2 Drawing Sheets

THRESHOLD VOLTAGE EXTRACTION CIRCUIT

TECHNICAL FIELD OF THE INVENTION

This invention relates to integrated circuits, and more particularly relates to MOSFET threshold voltage extraction circuits.

BACKGROUND OF THE INVENTION

Threshold voltage extraction circuits are important in various applications, for example, metal oxide semiconductor field effect transistor (MOSFET) process monitoring, device characterization, temperature sensing and voltage reference generation, based on its high linearity with temperature. A number of prior art circuits providing this function either have the shortcoming of requiring a twin-well process, or they are sensitive to power supply variation.

FIG. 1 shows a typical prior art threshold voltage extraction circuit. By driving n-type metal oxide semiconductor (NMOS) transistors M1 and M2 into saturation, the currents flowing in the two transistors, I1 and I2, respectively, are equal, if one neglects channel length modulation effects. Thus:

$$I1=K_1(V_{GS1}-V_{TH1})^2=I2=K_2(V_{GS2}-V_{TH2})^2, \quad \text{Eq. (1)}$$

where $V_{GSi}$ is the gate-to-source voltage of transistor Mi, $V_{THi}$ is the threshold voltage of transistor Mi, $K_i=K_p(W/L)_i$ of transistor Mi, and $K_p=\mu_o C_{ox}$. From theory, $\mu_o$ is the average electron mobility in the channel, and $C_{ox}$ is the gate oxide capacitance per unit area, for a given transistor.

By choosing $K_1=4K_2$, or sizing the transistors such that $(W/L)_1=4(W/L)_2$, and assuming that $V_{TH}=V_{TH1}=V_{TH2}$, the threshold voltage of the NMOS Device Under Test (DUT) can be expressed as:

$$V_{TH}=2V_{GS1}-V_{GS2}, \quad \text{Eq. (2)}$$

By fixing the gate bias $V_{GS2}$, and by using a current mirror circuit for the current sources for I1 and I2, the gate bias $V_{GS1}$ is automatically adjusted to satisfy Equation (2).

However, most prior art approaches to implementing such an arrangement use a stacked transistor array for the gain-of-two (X2) amplifier 102. The disadvantage of this is that a twin-well process is required to implement the stacked transistor array, which adds cost. In addition, a subtractor-transistor network or an instrumentation amplifier is typically used to provide the function of subtractor 101. This adds to the complexity of the circuit which, again, adds cost.

Therefore, it would be desirable to provide a threshold voltage extraction circuit which overcomes the problems of the prior art.

SUMMARY OF THE INVENTION

In accordance with the present invention, a threshold voltage extraction circuit is provided. The circuit includes a first current mirror having a first transistor and a second transistor. A holding circuit has an output adapted to control a current though the first current mirror by operating to maintain substantially equal the voltages at a first input thereof and at a second input thereof. A third, MOS transistor having a source and a gate, and a resistor circuit, together adapted to generate a voltage which is a multiple of a source-gate threshold voltage of the third transistor, are coupled to the second transistor and to the first input of the holding circuit. A fourth, MOS transistor coupled to the first transistor and to the second input of the subtracting circuit through a second resistor circuit is adapted to generate a threshold voltage across the second resistor circuit, by the operation of the holding circuit. A second current mirror coupled to the first current mirror is adapted to cause a current to flow through a third resistor circuit that corresponds to the current through the first current mirror to thereby provide an output voltage corresponding to the threshold voltage.

These and other features of the invention will be apparent to those skilled in the art from the following detailed description of the invention, taken together with the accompanying drawings.

DETAILED DESCRIPTION OF THE PREFERRED EMBODIMENT

The numerous innovative teachings of the present invention will be described with particular reference to the presently preferred exemplary embodiments. However, it should be understood that this class of embodiments provides only a few examples of the many advantageous uses and innovative teachings herein. In general, statements made in the specification of the present application do not necessarily delimit the invention, as set forth in different aspects in the various claims appended hereto. Moreover, some statements may apply to some inventive aspects, but not to others.

Figure 1:
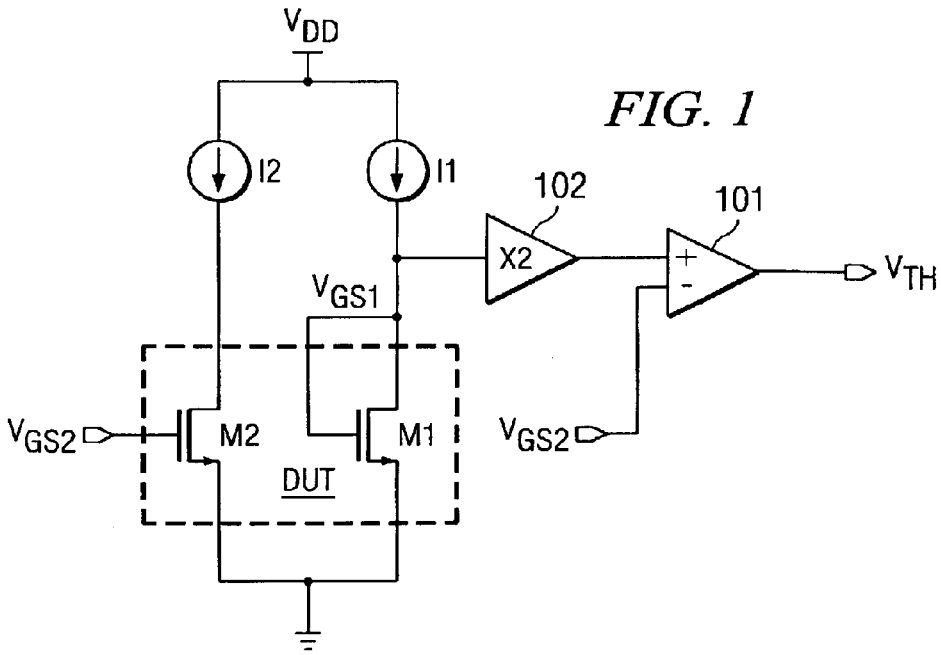
FIG. 1 is a circuit diagram of a typical prior art threshold voltage extraction circuit.
Figure 2:
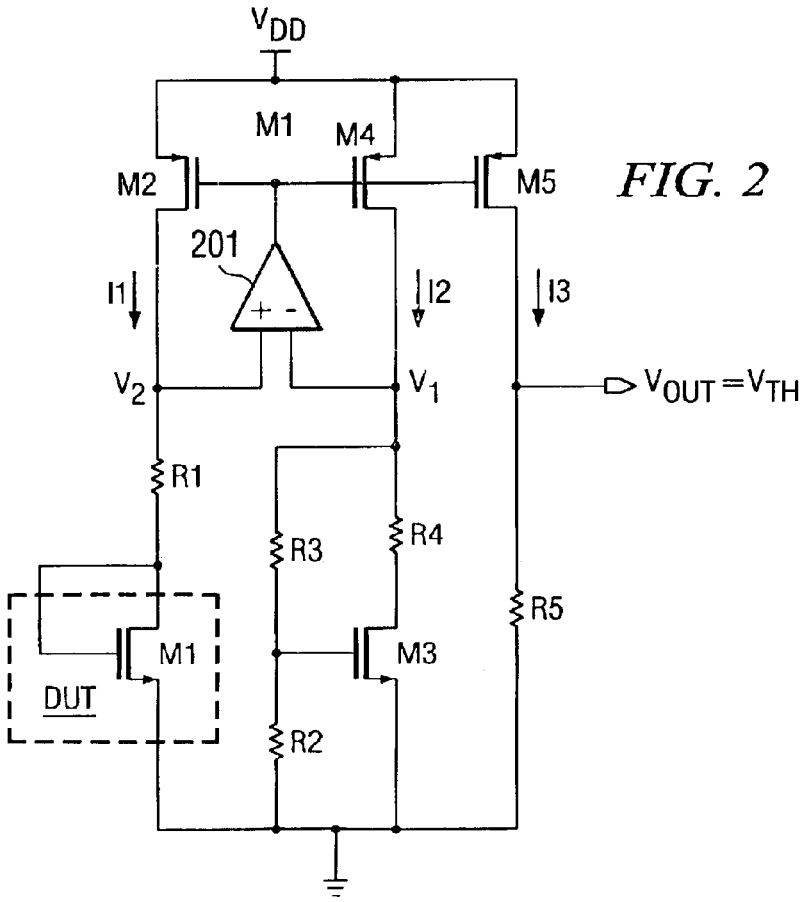
FIG. 2 is a circuit diagram of a threshold voltage extractor according to a first preferred embodiment of the present invention.

FIG. 2 is a circuit diagram of a threshold voltage extractor according to a preferred embodiment of the present invention. The circuit includes a first NMOS transistor M1 having its source connected to ground and its gate connected to its drain. Transistor M1 is the Device Under Test. One terminal of a resistor R1 is also connected to the drain of transistor M1. The other terminal of resistor R1 is connected to the non-inverting input of an operational amplifier (Op-amp) 201, and to the drain of a first p-type metal oxide semiconductor (PMOS) transistor M2, which has its source connected to a power supply supplying voltage $V_{DD}$. The common connection node of resistor R1, the non-inverting input of Op-amp 201 and transistor M2 is denominated node $V_2$. A second NMOS transistor M3 has its source connected to ground and its gate connected to one terminal of a second resistor R2, the other terminal of which is connected to ground. The gate of transistor M3 is also connected to one terminal of a third resistor R3, the other terminal of which is connected to one terminal of a fourth resistor R4, the other terminal of which is connected to the drain of transistor M3. The common connection node of resistors R3 and R4, denominated node $V_1$, is also connected to the inverting input of Op-amp 201, and to the drain of a second PMOS transistor M4, which has its source connected to $V_{DD}$. A third PMOS transistor M5 has its source connected to $V_{DD}$ and its drain connected to one terminal of a fifth resistor R5, which has its other terminal connected to ground. The output of Op-amp 201 is connected to the gates of transistors M2, M4 and M5. The output voltage, $V_{OUT}$, is taken at the common connection node of resistor R5 and transistor M5.

In the circuit of FIG. 2, the resistor network comprising resistors R2 and R3, which are equal, establishes the voltage $2V_{GS3}$ at node $V_1$. For example, resistors R2 and R3 could each have the value 5 MΩ. Resistors R1 and R4 are also equal, for example each having a value 100 KΩ, i.e. substantially less than that of resistors R2 and R3. Op-amp 201 operating on the current mirror formed by transistors M2 and M4 forces nodes $V_1$ and $V_2$ to be equal, thereby establishing the currents:

$$I1 = I2 = I3 = \frac{2V_{GS3} - V_{GS1}}{R1}, \quad \text{Eq. (3)}$$

where I1 is the current through transistor M2, I2 is the current through transistor M4, and I3 is the current through transistor M5. The drains of transistors M2 and M4 can be considered to be terminals of the current mirror they form, as a matter of terminology.

Thus, $V_{OUT}=I1 \cdot R5=2V_{GS3}-V_{GS1}=V_{TH}$.

Note that the value of resistor R5 can be chosen to be the same as, or multiple (X) times the value of resistors R1 and R4 so as to yield an output voltage $V_{OUT}$ of X times $V_{TH}$, where X is a positive value. Also note that optional resistor R4 is provided to reduce error due to channel length modulation effect.

Figure 3:
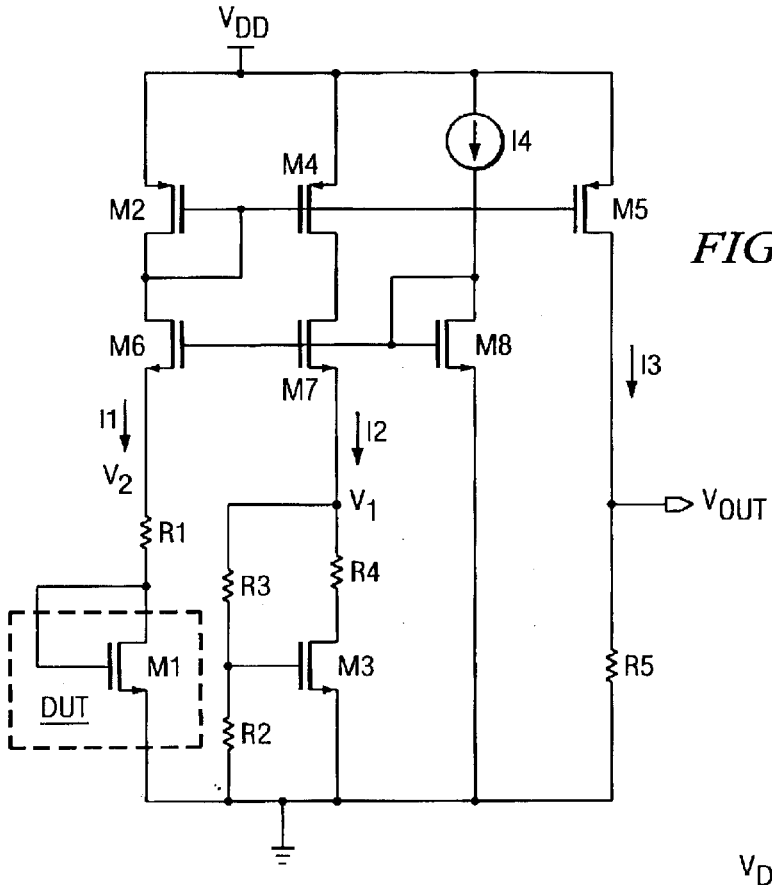
FIG. 3 is a circuit diagram of a threshold voltage extractor according to a second preferred embodiment of the present invention.

It will be appreciated that in implementing the invention, any circuit that operates to hold the voltages at nodes $V_1$ and $V_2$ to the same value may be used in the place of Op-amp 201. FIG. 3 shows one such alternative, among many. The circuit of FIG. 3 is similar to that of FIG. 2, but Op-amp 201 is replaced by NMOS transistors M6, M7 and M8, and current source 14. In FIG. 3, the drain of transistor M6 is connected to the drain and gate of transistor M2, and the source of transistor M6 is connected to node $V_2$, which is one terminal of resistor R1, the other terminal of resistor R1 being connected to the gate and drain of transistor M1. The drain of transistor M7 is connected to the drain of transistor M4, and the source of transistor M7 is connected to node $V_1$, which is the common connection node of resistors R3 and R4. The source of transistor M8 is connected to ground, and the gate and drain of transistor M8 is connected to a current source 14 which is connected to $V_{DD}$. The gates of transistors M6, M7 and M8 are connected together. The value I4 of current source I4 is selected to be substantially the same as currents I1, I2 and I3. In this way current 14 is mirrored by transistor M8 to transistors M6 and M7, and this operates to hold the voltages at nodes $V_1$ and $V_2$ to the same value.

Figure 4:
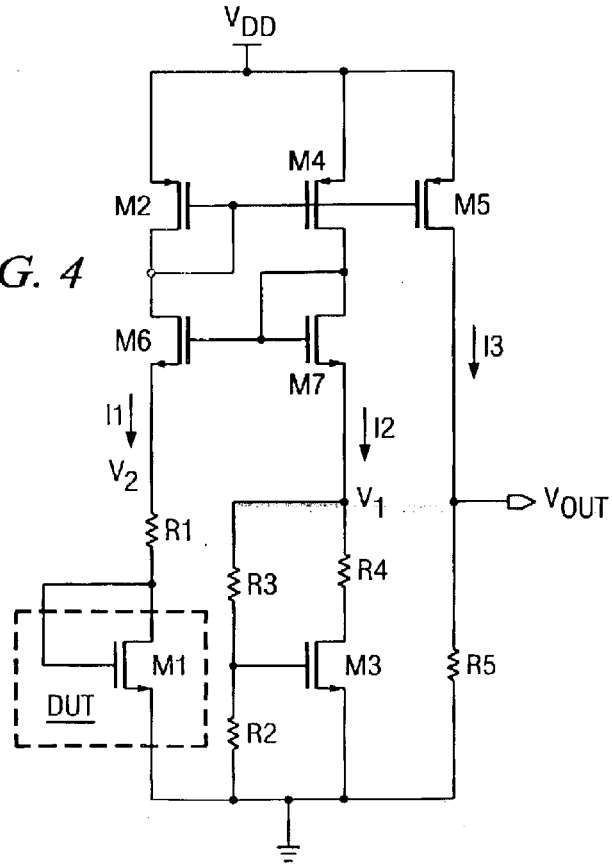
FIG. 4 is a circuit diagram of a threshold voltage extractor according to a third preferred embodiment of the present invention.

FIG. 4 shows another alternative. The circuit of FIG. 4 is similar to that of FIG. 2, but Op-amp 201 is replaced by NMOS transistors M6 and M7, where the drain of transistor M6 is connected to the drain and gate of transistor M2, and the source of transistor M6 is connected to node $V_2$, which is one terminal of resistor R1, the other terminal of resistor R1 being connected to the gate and drain of transistor M1. The gate and drain of transistor M7 are connected to the drain of transistor M4, and the source of transistor M7 is connected to node $V_1$, which is the common connection node of resistors R3 and R4. In this way the current through transistor M4, and thus through M7, is mirrored by transistor M7 to transistor M6, and this operates to hold the voltages at nodes $V_1$ and $V_2$ to the same value.

Finally, any circuit that generates a current corresponding to the current in the current mirror formed by transistors M2 and M4 may be used in the place of transistor M5, again, of which there are many.

Thus, embodiments of the present invention can provide the following advantages. First, the threshold voltage of a MOSFET device can be accurately determined, easing the effort in process monitoring, testing and characterization. Second, temperature sensing and compensation for a circuit can be conveniently provided, since the value of $V_{OUT}$ is sensitive to temperature variation, and is quite linear in its dependence on temperature. Third, implementations can be simple, with no special process steps required, such as twin-well for isolated devices. Finally, $V_{OUT}$ at multiple times the value of $V_{TH}$ can be conveniently provided, with considerable accuracy.

Although the present invention and its advantages have been described in detail, it should be understood that various changes, substitutions and alterations can be made herein without departing from the spirit and scope of the invention as defined by the appended claims.

What is claimed is:

1. A threshold voltage extraction circuit, comprising:

a first current mirror comprising a first transistor and a second transistor;

a holding circuit, having a first terminal, a second terminal, and an output, the holding circuit adapted to control a current through the first current mirror by operating to maintain substantially equal the voltages at a first terminal and at a second terminal;

a first resistor circuit coupled to the second transistor and the first terminal of the holding circuit, wherein the first resistor circuit comprises, a first resistor coupled between the source and gate of the third transistor, and a second resistor having a first terminal coupled to the gate of the third transistor, and having a second terminal coupled to the drain of the third transistor;

a third MOS transistor, having a drain, a source and a gate, the drain and the gate coupled to the first resistor circuit adapted to generate a voltage which is a multiple of a source-gate threshold voltage of the third transistor, the source coupled to ground;

a second resistor circuit coupled to the first transistor and to the second terminal of the holding circuit;

a fourth MOS transistor, having a drain, a source and a gate, the drain and the gate coupled to the second resistor circuit, the fourth MOS transistor adapted to generate a threshold voltage across the second resistor circuit, by the operation of the holding circuit;

a second current mirror coupled to the first current mirror, adapted to cause a current to flow through a third resistor circuit that corresponds to the current through the first current mirror to thereby provide and output voltage corresponding to the threshold voltage.

2. A threshold voltage extraction circuit according to claim 1, wherein the holding circuit comprises an operational amplifier.

3. A threshold voltage extraction circuit according to claim 1, wherein the holding circuit comprises:

a current source, providing a holding current corresponding to the current flowing through the second resistor circuit; and a third current mirror coupled to the current source to mirror the holding current to the first and second terminals of the first current mirror.

4. A threshold voltage extraction circuit according to claim 1, wherein the second resistor circuit comprises a resistor.

5. A threshold voltage extraction circuit according to claim 1, wherein the third resistor circuit comprises a resistor.

6. A threshold voltage extraction circuit according to claim 1, wherein the first resistor circuit further comprises comprising a third resistor having a first terminal coupled to the drain of the third transistor, and having a second terminal coupled to the second terminal of the third transistor.

7. A threshold voltage extraction circuit according to claim 1, wherein the holding circuit comprises a third current mirror coupled between the first current mirror and the third and fourth transistors, and adapted to mirror a current substantially the same as the current through the second transistor through the first transistor.

* * * * *